United States Patent [19]

Wiget

[11] 4,292,836

[45] Oct. 6, 1981

[54] APPARATUS FOR MEASURING THE RATE OF AN ANALOG-DISPLAY ELECTRONIC TIMEPIECE

[75] Inventor: Fridolin Wiget, Neuchatel, Switzerland

[73] Assignee: Ebauches S.A., Switzerland

[21] Appl. No.: 97,531

[22] Filed: Nov. 26, 1979

[30] Foreign Application Priority Data

Nov. 24, 1978 [CH] Switzerland ..... 12063/78

[51] Int. Cl.[3] ..... G04D 7/12

[52] U.S. Cl. ..... 73/6

[58] Field of Search ..... 73/6

[56] References Cited

U.S. PATENT DOCUMENTS 3,864,957 2/1975 Fujita ..... 73/6

3,892,124 7/1975 Reese ..... 73/6

*Primary Examiner*—S. Clement Swisher

*Attorney, Agent, or Firm*—Allegretti, Newitt, Witcoff & McAndrews

[57] ABSTRACT

An electronic measuring apparatus for measuring the rate of an analog-display electronic watch which comprises a quartz oscillator, a frequency divider with an adjustable division factor, a stepping motor and a circuit which, when the stem of the watch is pulled, produces a measuring signal emitted by the stray field of the coil of the stepping motor and comprising trains of pulses whose period and content are respectively representative of the frequency of the oscillator and the division factor. The measuring apparatus comprises a pick-up means for detecting said measuring signal, circuits for computing the rate of the watch and means for displaying said rate.

4 Claims, 2 Drawing Figures

APPARATUS FOR MEASURING THE RATE OF AN ANALOG-DISPLAY ELECTRONIC TIMEPIECE

BACKGROUND OF THE INVENTION

The present invention cencerns apparatus for measuring the rate of an electronic timepiece responding to an interrogation signal for emitting a wave formed by means of pulses, the measuring apparatus comprising means for detecting said wave, computing means responding to said detection means for providing a representation of the rate of the timepiece, and means for displaying said representation.

Electronic devices are known for measuring the rate of an analog-display electronic watch, comprising a stepping motor for detecting the stray magnetic field of the coil of the motor and precisely measuring the time which elapses between two drive pulses. Such devices give the desired measurement result when the watch is provided with a frequency divider which has a fixed division factor, but they are not suitable for measuring the rate of a watch comprising a frequency divider which has an adjustable division factor.

BRIEF SUMMARY OF THE INVENTION

The aim of the present invention is to provide improved measuring apparatus for measuring the rate of an electronic watch which emits a wave train of pulses in response to an interrogation signal.

BRIEF DESCRIPTION OF THE DRAWING

The drawing shows an illustrative embodiment of the invention which is given by way of example.

DETAILED DESCRIPTION OF THE PREFERRED EMBODIMENT

In order to simplify the following description, the following abbreviations will be used:

Logic state 0 or 1: '0' or '1' respectively
Flip-Flop D: FF
Monostable multivibrator: MONO
Reversible or up-down counter CPT
Latch decoder driver: LDD
Reset: RAZ
Input (or output) Xa of the element X: input (or output) Xa In addition, the term 'quartz second' will be used to denote a period of time which is equal to a second of ideal time, multiplied by the quotient of the nominal frequency and the real frequency of oscillation of the quartz of the watch in question.

Figure 1:
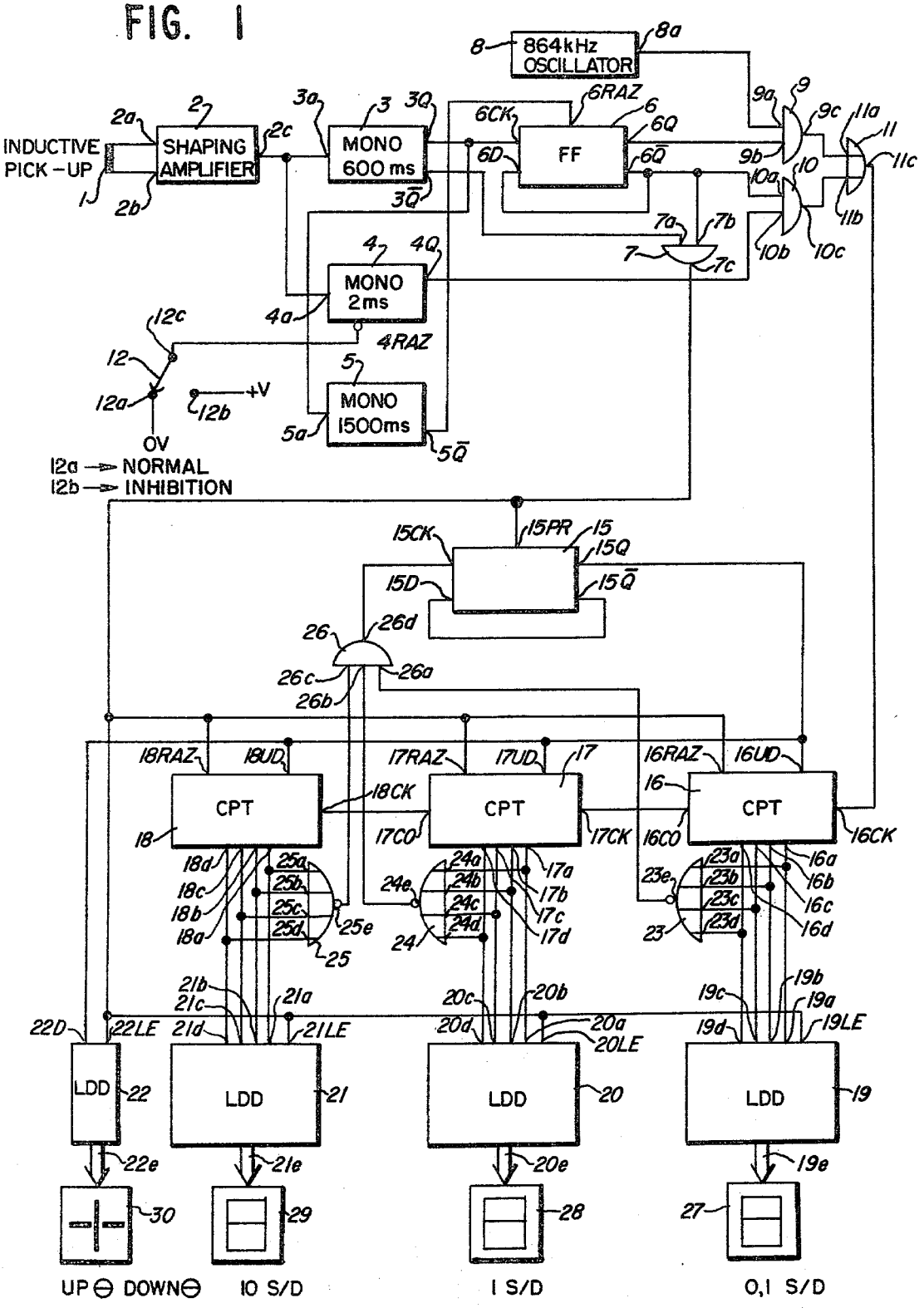
FIG. 1 shows the block circuit diagram of an illustrative embodiment of the subject of the invention.

An illustrative embodiment of electronic measuring apparatus according to the present invention is diagrammatically shown in FIG. 1.

An inductive pick-up means 1, which is formed for example by a coil wound on an armature of a material with a high level of magnetic permeability, is connected to the inputs 2*a* and 2*b* of a shaping amplifier 2. The output 2*c* of the amplifier 2 is connected to the control inputs 3*a* and 4*a* of the MONO 3 and 4.

The output 3Q of the MONO 3 is connected on the one hand to the control input 5*a* of a re-triggerable MONO 5 and on the other hand on the clock input 6CK of an FF 6. The output $3\overline{Q}$ is connected to the input 7*a* of an AND-gate 7 whose other input 7*b* is connected to the output $6\overline{Q}$. The latter is also connected to the input 6D.

The output of $5\overline{Q}$ of MONO 5 is connected to the input 6RAZ of the FF 6.

The output 8*a* of a precision oscillator 8 is connected to the input 9*a* of an AND-gate 9 whose other input 9*b* is connected to the output 6Q of FF 6.

The input 10*a* of an AND-fate 10 is connected to the output 6Q, while the other input 10*b* of AND-gate 10 is connected to the output 4Q of MONO 4.

The outputs 9*c* and 10*c* are respectively connected to the inputs 11*a* and 11*b* of an OR-gate 11.

The common point 12*c* of a change-over switch means 12 is connected to the input 4 RAZ of the MONO 4. The contact stud 12*a* of the change-over switch means 12 is connected to the negative terminal OV of a supply source (not shown) while the contact stud 12*b* is connected to the positive terminal +V of the same supply source.

The output 7*c* of AND gate 7 is connected on the one hand to the preselection input 15 PR of a FF 15 and on the other hand to the inputs 16 RAZ, 17 RAZ and 18 RAZ of three up-down counters 16, 17 and 18, and to the latch inputs 19 LE, 20 LE, 21 LE and 22 LE of four latch decoder drivers 19, 20, 21, and 22. The output 11*c* of OR gate 11 is connected to the clock input 16 CK of counter 16.

The output 15Q of FF 15 is connected to the input 15 D of FF 15, and the output 15Q is connected to the control inputs for controlling the counting direction, at 16 UD, 17 UD and 18 UD, of the counters and to the input 22 D of latch decoder driver 22. The carry-over outputs 16 CO and 17 CO of counters 16 and 17 are connected to the clock inputs 17 CK and 18 CK respectively, of counters 17 and 18.

The binary outputs 16*a* to 16*d* of counter 16 are connected on the one hand to the BCD inputs 19*a* to 19*d* respectively of driver 19, and on the other hand to the inputs 23*a* to 23*d* respectively of a NOR gate 23.

The binary outputs 17*a* to 17*d* of counter 17 are connected on the one hand to the BCD inputs 20*a* to 20*d* respectively of driver 20, and on the other hand to the inputs 24*a* to 24*d* respectively of a NOR gate 24.

The binary outputs 18*a* to 18*d* of counter 18 are connected on the one hand to the BCD inputs 21*a* to 21*d* respectively of driver 24, and on the other hand to the inputs 25*a* to 25*d* respectively of a NOR gate 25.

The outputs 23*e*, 24*e* and 25*e* of the NOR gates 23, 24 and 25 are respectively connected to the inputs 26*a*, 26*b* and 26*c* of an AND date 26. The output 26*d* of the latter is connected to the clock input 15CK of FF15.

The seven control outputs 19*e* of latch decoder driver 19 are connected to the seven corresponding segments of a display member 27 for displaying tenths of a unit. The seven control outputs 20*e* of latch decoder driver 20 are connected to the seven corresponding segments of a display member 28 for displaying units. The seven control outputs 21*e* of latch decoder driver 21 are connected to the seven corresponding segments of a display member 29 for displaying tens of units. The control outputs 22*e* of latch decoder driver 22 are connected to the corresponding segments of a display means 30 for displaying the signs '—' or '+'.

A point 31 which marks the separation between the display of the units at 28 and the tenths of units at 27 is formed, for example, by a permanently-fed light-emitting diode.

Figure 2:
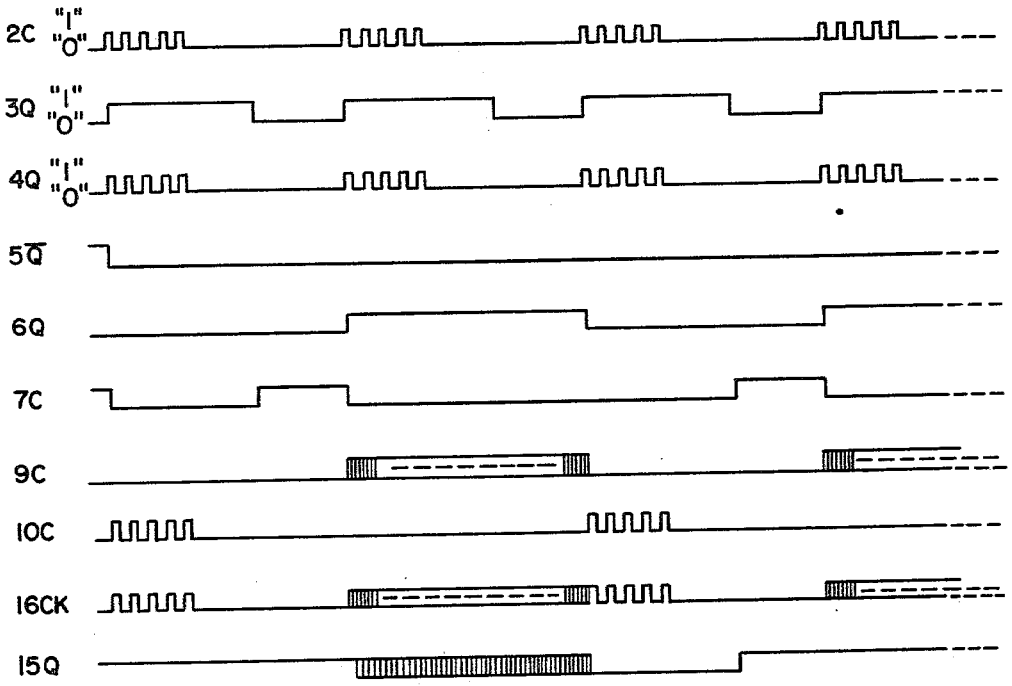
FIG. 2 is a diagram illustrating the mode of operation of the apparatus of FIG. 1.

The mode of operation of the measuring apparatus shown in FIG. 1 will now be described with reference to FIG. 2 showing a diagram of the signals involved, and, as a beginning, in regard to measuring the rate of an inhibition-type watch.

In such a watch, adjustment of the frequency of the output signal of the divider is effected by periodic suppression or inhibition of a certain number N of pulses at the input of one or more stages of the divider. The adjustment circuit is so arranged that a unit of the number N corresponds at least approximately to a correction of 0.1 seconds/day in the rate of the watch.

An arrangement of this kind is used in watches whose oscillator has a higher real frequency than its nominal frequency.

In order to measure the rate of such a watch, the switching means 12 must be set at position 12*b* to 12*c*. The potential of the positive terminal of the supply source, which corresponds to the logic state '1', is therefore applied to the input 4 RAZ which permits the MONO 4 to operate.

The pick-up means 1 receives the magnetic signal produced by the stray magnetic field of the coil of the stepping motor of the watch (not shown) comprising trains of pulses, and converts them into a voltage signal which is amplified and shaped by the amplifier 2. The output signal 2*c* of the amplifier 2 is shown in FIG. 2 and is similar to the measuring signal supplied by the magnetic field of the watch. The signal 2*c* comprises periodic trains of pulses. The period of the trains of pulses is equal to one quartz second and the number of pulses in each train is equal to the above-indicated number N.

The positive leading edge of each train of pulses of the signal 2*c* triggers the MONO 3 which produces a pulse which is, for example, 600 mS in length at its output 3Q. The positive edge of each pulse of the signal 2*c* also triggers the MONO 4 whose input 4 RAZ is rendered inactive by the signal '1' supplied by the switching means 12, and which provides at its output 4Q a pulse which is, for example, 2 mS in width, for each pulse of the measuring signal.

The output 5Q switches from '1' to '0' at the positive edge of the first pulse of the signal appearing at the output 3Q and remains at '0' for a period, for example, of 1.5 seconds, that is to say, for a period of more than 1 quartz second.

Before the first pulse of the signal 2*c*, the input 7*c* is at state '1' because the signals $3\overline{Q}$ and $6\overline{Q}$ are both at stage '1'. The result of this is that the outputs of the counters CPT 16 to 18 are at state '0' and the output 15 Q of the FF 15 is at '1'. When the signal $3\overline{Q}$ switches to state '0', the output 7*c* also changes to '0'. Subsequently, the output 7*c* is at '1', whenever the signals $3\overline{Q}$ and $6\overline{Q}$ are at '1' at the same time.

The FF6 does not react to the first pulse of the signal 3Q because the signal $5\overline{Q}$ is still at state '1', when the positive edge of the signal 3Q reaches its clock input 6 CK, so that its output 6Q remains at state '0'. On the other hand, as soon as the second pulse of the signal 3Q arrives, the FF 6 changes state at each positive edge of that signal. Its output 6Q therefore alternatively switches to states '1' and '0', each for a period of a quartz second.

Whenever the output 6Q is at '1', the gate 9 passes the signal at a frequency of 864 kHz which is supplied by the output of the quartz oscillator 8. A certain number of pulses at that frequency therefore appear at the output 9*c*, during each period of the measuring signal.

It is possible to specify that the frequency of 864 kHz give a number of pulses per second, which is identical to the number of tenths of seconds which elapse in the course of a day. The difference between the number 864,000 and the number of pulses transmitted by the gate 9 during a quartz second is therefore equal to the rate of the watch being measured, expressed in tenths of a second per day, no account being taken of the correction made to the division factor of its frequency divider. Thus, for example, if the gate 9 passes 863,993 pulses during a quartz second, that means that the watch would be fast by seven tenths of a second per day, if its divider had its nominal division factor.

On the other hand, when the output $6\overline{Q}$ is at state '1' the signal 4Q, which is formed by pulses which are equal in number to the number contained in the memory of the circuit for adjusting the division factor of the divider of the watch being measured, appears at output 6*c*.

The output 11*c* supplies a signal which is the result of the logic addition of the signals at the outputs 9*c* and 10*c*. This signal which is applied to the clock impulse 16CK of the counter 16 therefore comprises a train of pulses at the frequency 864 kHz of a duration of a quartz second, followed by a number of pulses which is identical to the number of pulses which are suppressed, among the pulses supplied by the oscillator during a division cycle in normal operation of the watch. This signal therefore contains the information relating to the rate of the watch in the form of 864 thousand $(1-E)+N$ pulses in each period of the signal 16CK wherein E is the frequency error of the quartz of the watch being measured, with respect to the nominal frequency, and N is the number of pulses which are suppressed during a division cycle of the watch.

The gates 23 to 26 and the FF 15 form a circuit for controlling the direction of counting of the CPT 16 to 18.

At the moment at which the positive edge of the first pulse of the signal 16 CK occurs, the signal supplied by the output 7*c* to the RAZ input of the CPT 16 to 18 goes from '1' to '0' and the signal for controlling the direction of counting, at 15Q, of the same CPT 16 to 18, is at '1'; the CPT 16 is consequently incremented by a unit at each pulse. At the ninth of those pulses (positive leading edge), the output 16CO goes from '1' to '0' and, at the tenth pulse, the output 16CO goes from '0' to '1', thus incrementing the second CPT 17 by a unit. The same procedure occurs for the following pulses: with all ten pulses arriving at the input of the CPT, a pulse appears at its output. The CPT 17 and 18 operate in the same manner as the CPT 16, except that the output of the CPT 18 is not used.

The output states at outputs 16*a* to 16*d*, 17*a* to 17*d* and 18*a* to 18*d* therefore permanently represent the number of pulses received at the input 16CK (inasmuch as the inputs 16UD, 17UD, and 18UD remain at '1'). This number is expressed in binary coded decimal (BCD), that is to say, the states at the outputs 16*a* to 16*d*, 17*a* to 17*d* and 18*a* to 18*d* respectively represent in binary form the digit relating to the units, tens and hundreds of that number, which can therefore vary from 000 to 999.

When the input 16CK receives the thousandth pulse, the binary outputs of the three CPT all pass from '1001' to '0000', that is to say, from 9 to 0 in decimal form. At that moment, the outputs 23*e*, 24*e* and 25*e* are all at '1' and the output of the gate 26 supplies a pulse to the clock input of the FF15 which thus switches over, causing the inputs 16UD to 18UD to go from '1' to '0'.

From that moment, each pulse arriving at the input 16CK no longer causes incrementation but decrementation of the CPT 16 to 18. When the input 16CK receives the two thousandth pulses, the binary outputs of the CPT all go from '0001' to '0000' and a pulse at the input 15CK again causes switching of the FF15, this again giving a state '1' at the inputs 16UD to 18UD, and the CPT will again be incremented and the same procedure begins again.

Thus, for each even thousand pulses (from 0 to 999, from 2000 to 2999, etc.) the CPT 16 to 18 are incremented by the pulses arriving at the input 16CK, while for each uneven thousand pulses (from 1000 to 1999, from 3000 to 3999, etc.), they are decremented.

LDD 19, LDD 20 and LDD 21 receive the information regarding the state of the counters 16, 17 and 18 on inputs 19*a* to 19*d*, 20*a* to 20*d* and 21*a* to 21*d*, respectively.

This information is memorized by the LDD latch decoder driver when their input LE goes from '0' to '1'. The decoders convert the memorized information so as to be able to control the display elements 27 to 29 which are connected to the outputs 19*a* to 21*e*. The LDD 22 controls the element 30 for displaying the signs '−' and '+'. When its input 22*d* is at '0', the element 30 displays the sign '+'; when its input is at '1', it displays the sign '−'.

When the output 6Q returns to state '0', at the end of the quartz second, which is shorter than a normal second since the real frequency of the oscillator of the watch is higher than its nominal frequency, the input 16CK has received for example 863,991 pulses. At that moment, the content of the CPT is '00.9' because, from 863,000 to 864,000, the output 15Q of the FF 15 being at state '0', the CPT are decremented.

The input CK16 then receives the pulses contained in a train of pulses of the signal 2*c*, that is to say, in our example, five pulses, which sets the content of the CPT to '00.4'. When the output 7*c* then passes to state '1', the inputs 19LE to 22LE and 16RAZ to 18RAZ also go to '1', which first causes memorization of the state of the outputs of the CPT 16 to 18 in LDD 19 to 21 and, consequently, display by the display elements 27 to 29 of the content of said counters, and, just afterwards, resetting to zero of the outputs of the CPT 16 to 18. With the input 22D being at '0', the display element 30 displays the sign '+'. In this example, the readout therefore shows that the watch being measured is four tenths of a second per day fast.

If the input 16CK had received, for example, a total number of 864,005 pulses during a counting cycle, the display would have indicated '−00.5', which would have shown that the watch was slow by five tenths of a second per day.

In order to measure the rate of an analog-display electronic watch comprising a frequency divider with a fixed division factor, the switching means 12 is placed in position 12*a* to 12*c*. With the input 4RAZ of the MONO 4 being constantly at '0' in this case, the outputs 4Q and 10*c* are also constantly at '0'. Consequently, the input 16CK of the counter 16 receives solely the signal 9*c* in FIG. 2. As the signal arriving at the inputs of the amplifier 2 is generally formed, in such watches, by pulses which are alternately positive and negative and which are separated from each other by a second, the amplifier 2 is so arranged as to supply pulses which are only positive, with the negative pulses of the pairs of pulses being converted to positive pulses.

The CPT 16 to 18 count the pulses at frequency 864 kHz during the period of time which separates two pulses of the signal 2*c*, that is to say, during a quartz second.

If the oscillator 8 supplies precisely 864,000 pulses in a quartz second, the display elements will display a zero value, that is to say, that the rate of the watch is zero.

If the quartz second differs from the second as determined by the oscillator 8, the display elements will indicate the value and the mathematical sign of the rate of the watch with respect to the time base of the measuring apparatus.

Various other modifications may be made in the form of the invention without departing from the principles disclosed in the foregoing illustrative embodiments. It is intended therefore that the accompanying claims be construed as broadly as possible consistent with the prior art.

What is claimed is:

1. Apparatus for measuring the rate of an electronic timepiece responding to an interrogation signal by emitting a wave formed by trains of pulses, said apparatus comprising means for detecting said wave, computing means responding to said detection means and providing a representation of the rate of the timepiece, and means for displaying said representation, wherein said computing means comprises means for producing a first number of pulses representing the period of said trains of pulses, means for producing a second number of pulses representing the content of said trains of pulses, and means for combining said first and second number of pulses and providing said representation.

2. Apparatus according to claim 1 wherein the means for producing said first number of pulses comprises means for producing a first signal whose duration is representative of the period of said trains of pulses, oscillator means for producing a second signal having a reference frequency, and means for combining said first and second signals.

3. Apparatus according to claim 1 wherein said means for producing said second number of pulses comprises means for decoding the content of said trains of pulses.

4. Apparatus according to claim 1 wherein said computing means comprises an up-down counter which is coupled to said combining means and a control circuit which is coupled to said counter for changing the direction of counting of the counter in response to given states at its outputs.

* * * * *